US005127793A

United States Patent [19]

Walker et al.

[11] Patent Number: 5,127,793

[45] Date of Patent: Jul. 7, 1992

[54] TURBINE SHROUD CLEARANCE CONTROL ASSEMBLY

[75] Inventors: Alan Walker, Wyoming, Ohio; Thomas G. Wakeman, Lawrenceburg, Ind.; Dean T. Lenahan, Cincinnati; Larry W. Plemmons, Fairfield, both of Ohio; Andrew P. Elovic, Rishon Lezion, Israel

[73] Assignee: General Electric Company, Cincinnati, Ohio

[21] Appl. No.: 531,288

[22] Filed: May 31, 1990

[51] Int. Cl.[5] ..... F01D 5/14

[52] U.S. Cl. ..... 415/115; 415/173.1; 415/173.3; 415/189; 415/190; 415/208.1; 415/209.2; 415/209.3

[58] Field of Search ..... 415/115, 116, 189, 190, 415/208.1, 209.2, 209.3, 173.1, 173.3

[56] References Cited

U.S. PATENT DOCUMENTS

| | | | |
|---|---|---|---|
| 998,820 | 7/1911 | Westinghouse | 415/173.1 X |
| 2,472,062 | 6/1949 | Boestad et al. | 253/69 |
| 2,680,001 | 6/1954 | Batt | 415/115 |
| 3,551,068 | 12/1970 | Scalzo et al. | 415/115 X |
| 3,742,706 | 7/1973 | Klompas | 415/115 X |
| 3,836,279 | 9/1974 | Lee | 415/115 X |
| 3,975,114 | 8/1976 | Kalkbrenner | 415/209.2 X |
| 4,126,405 | 11/1978 | Bobo et al. | 415/115 |
| 4,157,232 | 6/1979 | Bobo et al. | 415/116 |
| 4,177,004 | 12/1979 | Riedmiller | 415/116 |
| 4,183,539 | 1/1980 | French et al. | 277/22 |
| 4,373,575 | 2/1983 | Hayes | 165/7 |
| 4,575,099 | 3/1986 | Nash | 277/12 |
| 4,576,547 | 3/1986 | Weiner et al. | 415/116 |
| 4,662,658 | 5/1987 | Holowach et al. | 285/177 |
| 4,767,260 | 8/1988 | Clevenger et al. | 415/115 |
| 4,813,608 | 3/1989 | Holowach et al. | 239/265.37 |
| 4,821,771 | 4/1989 | Maxwell | 137/625.44 |
| 4,844,688 | 7/1989 | Clough et al. | 415/116 |

FOREIGN PATENT DOCUMENTS

| | | | |
|---|---|---|---|
| 2907769 | 12/1979 | Fed. Rep. of Germany | 415/116 |
| 1345018 | 10/1963 | France | 415/115 |
| 2305596 | 10/1976 | France | 415/116 |
| 2438165 | 10/1978 | France . | |
| 2422026 | 4/1979 | France . | |
| 1082634 | 9/1967 | United Kingdom . | |
| 2017826 | 10/1979 | United Kingdom | 415/115 |
| 2019954 | 11/1979 | United Kingdom | 415/190 |
| 2089439 | 6/1982 | United Kingdom | 415/116 |
| 2108586 | 5/1983 | United Kingdom | 415/116 |
| 2119452 | 11/1983 | United Kingdom . | |
| 2195715 | 4/1988 | United Kingdom . | |
| 0806815 | 12/1988 | United Kingdom . | |
| 2226365 | 6/1990 | United Kingdom . | |

*Primary Examiner*—Edward K. Look
*Assistant Examiner*—Todd Mattingly
*Attorney, Agent, or Firm*—Jerome C. Squillaro; David L. Narciso

[57] ABSTRACT

The clearances between an array of high pressure turbine blades and its surrounding high pressure turbine shroud as well as the clearances between an array of low pressure turbine blades and its associated low pressure turbine shroud are carefully controlled by a support structure which provides for evenly controlled circumferential cooling of the shroud support structure. Radial loads on the shroud support structure are reduced by counterbalancing loads imposed on the support structure by the shroud with predetermined pressure loads controlled and set through a series of cooling air cavities. The high pressure turbine shroud and low pressure turbine shroud are formed as integral segments in a segmented shroud design. Forward and aft shroud hanger members interconnect the shroud with its support so as to facilitate assembly and disassembly of the shroud segments to and from their support structure.

18 Claims, 8 Drawing Sheets

TURBINE SHROUD CLEARANCE CONTROL ASSEMBLY

The Government has rights in this invention pursuant to Contract No. F33657-83-C-0281 awarded by the Department of Air Force.

BACKGROUND OF THE INVENTION

1. Field of the Invention

This invention relates generally to a gas turbine engine shroud, and particularly relates to a uniformly cooled and pressure balanced segmented shroud wherein each shroud segment continuously spans both the high pressure turbine blades and the low pressure turbine blades. This design eliminates a row of stationary vanes between the rotating blades thereby providing a large reduction in weight, significant cost savings and increased performance through reduced cooling air requirements.

2. Description of Prior Developments

The primary function of a gas turbine engine shroud is to provide a contoured annular surface along the exhaust gas outer flowpath and to define as small a clearance as possible with the tips of the rotating turbine blades. Maintaining this small clearance is necessary to minimize the escape of exhaust gas between the blade tips and the outer flowpath surface. The radial clearance between the rotating blade tips and the stationary shroud has a significant effect on turbine efficiency, with small clearance providing greater efficiency.

The effect of blade tip clearance on turbine efficiency and performance is most significant on the high reaction gas turbine applications in which the present invention is used. The tighter the clearance gap can be maintained, the better the performance of the turbine. Therefore, much effort is placed in the design of the shroud as well as its shroud support to provide maximum control over the radial position of the shroud, as the radial position of the shroud defines the blade tip clearance.

Since the minimum clearance between the shroud and the blades, i.e. the pinch-point, normally occurs during transient operation, it is of critical importance to control the transient response of the shroud support in order to maintain acceptable blade tip clearance levels at steady state operating conditions. Ideally, the stator response should match the rotor transient response in order to achieve minimum steady-state clearances and improve engine performance.

To achieve good engine performance, it is also necessary to maintain the shroud and its shroud support as round as possible. Non-uniform mechanical and/or thermal radial loads which tend to distort the shroud support and the shroud may cause local rubbing on the shroud by the blade tips. This creates non-uniform shroud wear and associated blade tip loss and results in degraded engine performance.

The shroud support design shown in FIG. 1 is typical of known conventional designs. The clearance control or support rings 10, 12 formed on the engine case 14 are heated and cooled by cooling air circuits which direct the cooling air tangentially within channels formed between the clearance control rings. The high pressure turbine shroud 18 is separate and axially spaced from the low pressure turbine shroud 20. The free ends of the high pressure turbine blades 22 and the low pressure turbine blades 24 define clearance gaps 25 with the respective shrouds 18, 20.

Testing of this conventional design has revealed circumferential temperature gradients exceeding 80° F. This temperature variation is believed to be primarily due to the under cowl environment and leakage of cooling air around various pipe fittings 16. Such temperature gradients may drive open the blade tip clearance gaps 25 by 0.008 inch after blade tip rubbing. This is a significant penalty since steady state clearances are generally in the range of 0.015–0.020 inch.

A major concern in the design of any shroud system is its ability to use cooling air effectively and to reduce parasitic leakage of this air. Current high pressure turbine designs are cooled using compressor discharge air routed around the combustor and nozzle outer support bands. Leakage of this air to the exhaust gas flowpath is typically controlled by using thin sheet metal shim seals between shroud segment ends. Such conventional shroud designs allow full shroud coolant pressure to leak across these seals. This leakage is represented in FIG. 1 by directional arrows 23.

More recent designs, such as that shown in FIG. 2, have incorporated continuous 360° impingement baffles 26, thereby reducing the pressure differential across the shroud end seals 21. This lower pressure differential results in reduced coolant leakage. The 360° impingement baffle design, however, is not adaptable to a segmented shroud hanger configuration such as that schematically depicted in FIG. 2(*a*). This can be a drawback as it is desirable to form the shroud hangers 19 as a series of circumferentially spaced segments which prevent the non-uniformly heated flowpath shrouds 18 from influencing the temperature of the shroud support which is preferably formed as a continuous 360° support ring 12. In this manner, the segmented shroud hanger thermally isolates the shroud from the support ring 12.

Accordingly, a need exists for a segmented gas turbine engine shroud which maintains a close, circumferentially uniform clearance with respect to the rotating turbine blades during both transient and steady state engine operating conditions.

A further need exists for a gas turbine engine shroud support which is evenly circumferentially heated and cooled so that circumferential temperature gradients are avoided and so that the attached shrouds are maintained as close to round as possible at all times.

Yet another need exists for a gas turbine engine shroud which effectively uses cooling air by reducing pressure differentials across the shroud seals thereby reducing parasitic leakage of the cooling air.

Another object of the invention is to control and uniformly maintain the heat transfer coefficients along the shroud support, and particularly along the annular radial flanges which form the three shroud support position control rings.

Another object of the invention is to control the pressure adjacent and between the shroud support and the segmented shroud so that radial loads on these members are minimized or eliminated.

Another object of the invention is to provide a shroud which spans two adjacent rotors and provides blade tip clearance control to both. Use of separate shrouds for each rotor would result in more component parts, joints and greater leakage of cooling air through the joints.

Still another object of the invention is to facilitate the assembly and disassembly of a segmented gas turbine engine shroud to and from its hangers and shroud support member.

SUMMARY OF THE INVENTION

The present invention has been developed to fulfill the needs noted above and therefore has as a primary object the provision of a segmented gas turbine engine shroud which continuously spans both the high pressure turbine blades and the low pressure turbine blades.

Briefly, the present invention provides a segmented gas turbine engine shroud supported by forward and aft shroud hangers, with two shroud segments being supported by each hanger. The shroud hangers are in turn supported by a continuous 360° shroud support which is bolted to the gas turbine engine casing via an annular aft radial mounting flange formed on the shroud support. The shroud support, which controls the radial position of the shroud, maintains tight radial clearances between the turbine blades and the segmented shroud via three distinct 360° continuous radial flanges or position control rings, one of which serves as the aft radial mounting flange.

A series of annular cooling air cavities is defined between the shroud segments, the engine or combustor casing and the forward and aft shroud hangers. The ports which interconnect the annular cavities are dimensioned to provide for choked or near choked flow from one cavity to the next. Thus, the flow rate of cooling air into the cavities effectively remains constant even though the total flow of cooling air may vary.

This constant flow rate provides for uniform 360° circumferential cooling of the shroud and its support member and maintains and controls the heat transfer coefficient on the three position control rings. This constant flow in turn ensures controlled uniform thermal expansion and contraction of the shroud support and thus enables accurate control of the clearance between the turbine blades and the shroud. Another advantage gained by directing the cooling air through a series of cavities is the reduction of cooling air leakage by sequentially decreasing the air pressure in the cooling air cavities in a downstream direction.

The pressure in each cooling air cavity is maintained at a predetermined value to counteract the loads applied to the shroud support via the shroud hangers. In this manner, the mechanical loads on the shroud support can be minimized. By reducing the mechanical loads, a lighter shroud support assembly may be designed, as material sections of the shroud support member may be reduced.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

FIG. 2(*a*) is a fragmental schematic diagram of a conventional segmented shroud hanger design;

FIG. 4(*a*) is a fragmental axial sectioned view of the cooling air circuit around the rear position control ring of FIG. 4;

FIG. 4(*b*) is a sectional view of the cooling air paths of FIG. 4(*a*) taken along line A—A of FIG. 4(*a*);

FIG. 4(*c*) is an exploded perspective view of the shroud support system of FIG. 4;

FIG. 11(*a*) is a fragmental view of a shroud segment;

FIG. 11(*b*) is an enlarged view of a dimpled shroud mid mounting hook;

FIG. 11(*c*) is a sectional view taken through line G—G of FIG. 11(*a*);

In the various figures of the drawing, like reference characters designate like parts.

DETAILED DESCRIPTION OF THE PREFERRED EMBODIMENT

Figure 3:
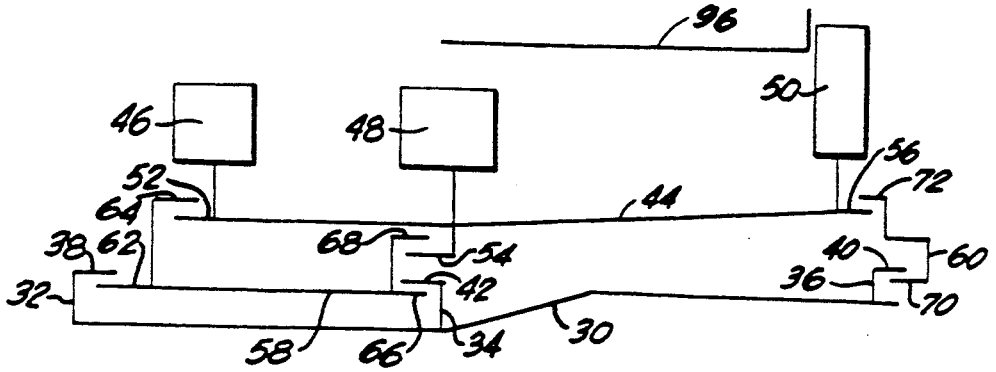
FIG. 3 is a schematic diagram of the shroud system of FIG. 4 showing in simplified form the relative locations and interconnections between the segmented shrouds, the segmented shroud hangers, the shroud support and the shroud support position control rings.

The present invention will now be described in conjunction with the drawings beginning with FIG. 3 which shows a general schematic layout of the shroud support system according to the invention. A one-piece shroud segment 30 is provided with a forward mounting hook 32, a central or mid mounting hook 34 and a rear mounting hook 36. The front and rear mounting hooks 32, 36 are respectively formed with free ends 38, 40 which extend axially rearwardly while the mid mounting hook 34 is formed with a free end 42 which extends axially forwardly.

A number of shroud segments 30 are arranged circumferentially in a generally known fashion to form a segmented 360° shroud. A number of forward and aft segmented shroud hangers 58, 60 rigidly interconnect the shroud segments 30 with the shroud support 44. Each segmented hanger 58, 60 circumferentially spans and supports two shroud segments 30. There are typically 32 shroud segments and 16 forward shroud hangers and 16 aft hangers in the assembly.

Each segmented shroud hanger and accompanying shroud pair is rigidly supported by a one-piece, continuous 360° annular shroud support 44. The radial position of each shroud segment 30 is closely controlled by three distinct 360° support flanges or position control rings 46, 48, 50 provided on the shroud support 44. The front and mid position control rings 46, 48, are respectively formed with axially forwardly projecting mounting hooks 52, 54 while the rear position control ring 50 is formed with an axially rearwardly projecting mounting hook 56. An exploded view of this assembly is provided in FIG. 4(*c*) for clarity, wherein axial stiffening ribs 31 are shown provided on each shroud segment 30.

To maximize the radial support and radial position control provided to each shroud segment 30 by the shroud support 44, each mounting hook 52, 54, 56 on the shroud support is in direct axial alignment (i.e. aligned in the same radial plane) with its respective position control ring 46, 48, 50. This alignment increases the rigidity of the entire shroud support assembly.

The shroud support is bolted into the combustor case 96 at its aft end. The entire shroud support assembly is cantilevered off its aft end at the rear position control ring 50. The forward and mid-position control rings, which are several inches away from the aft flange, are thereby well divorced from any non-uniform circumferential variations in radial deflection in the combustor case.

The segmented shroud design is required to accommodate the thermal strains imposed by the hostile environment created by the hot flowing exhaust gas. The segmented shroud hangers effectively cut the heat conduction path between the high temperature shroud mounting hooks and the position control rings. The position control rings are thus well isolated from the hostile and non-uniform flowpath environment.

Figure 4:
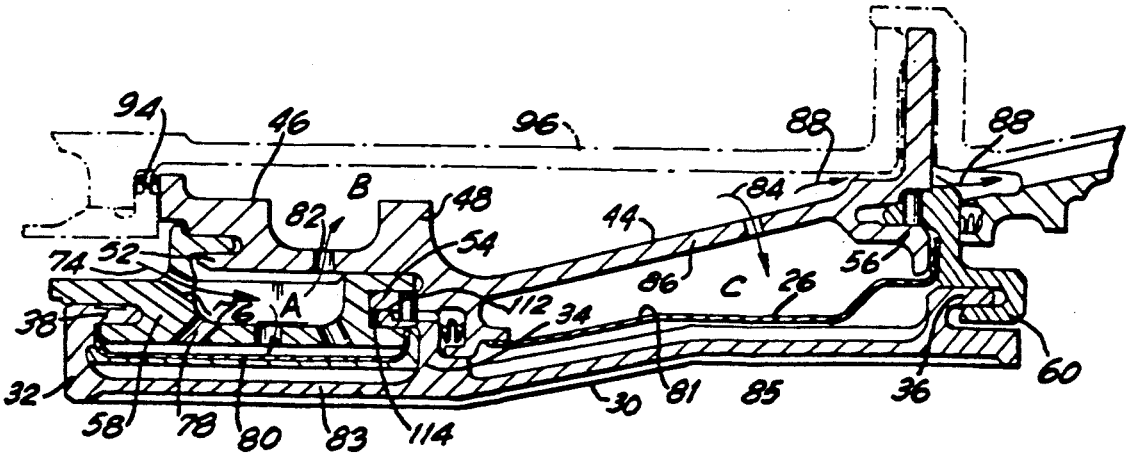
FIG. 4 is a fragmental axial sectional view of a gas turbine engine shroud system according to the present invention.
Figure 4A:
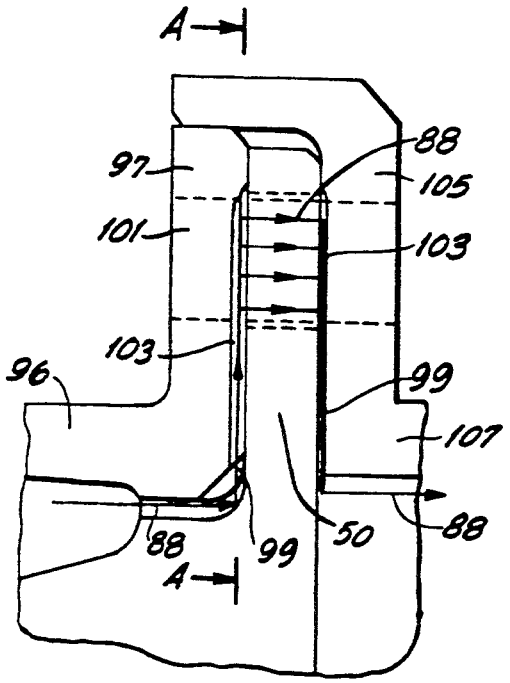
Figure 4B:
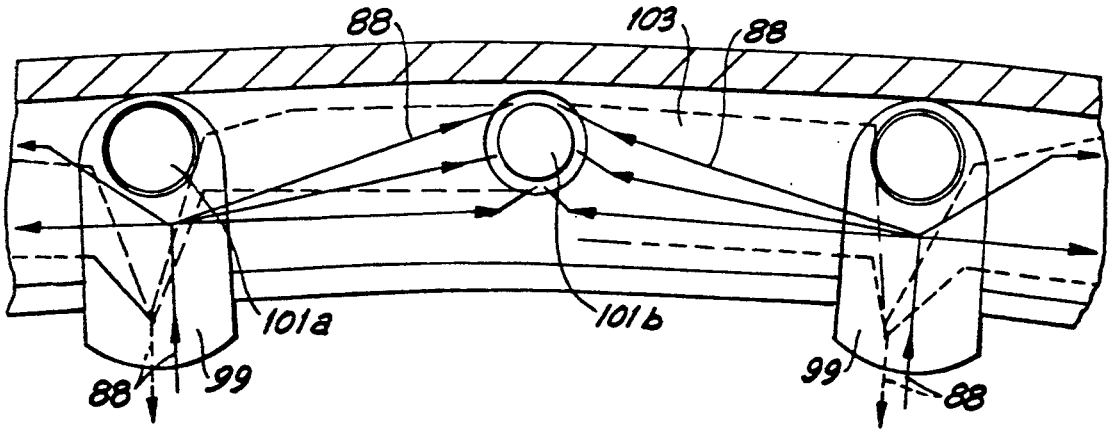
Figure 4C:
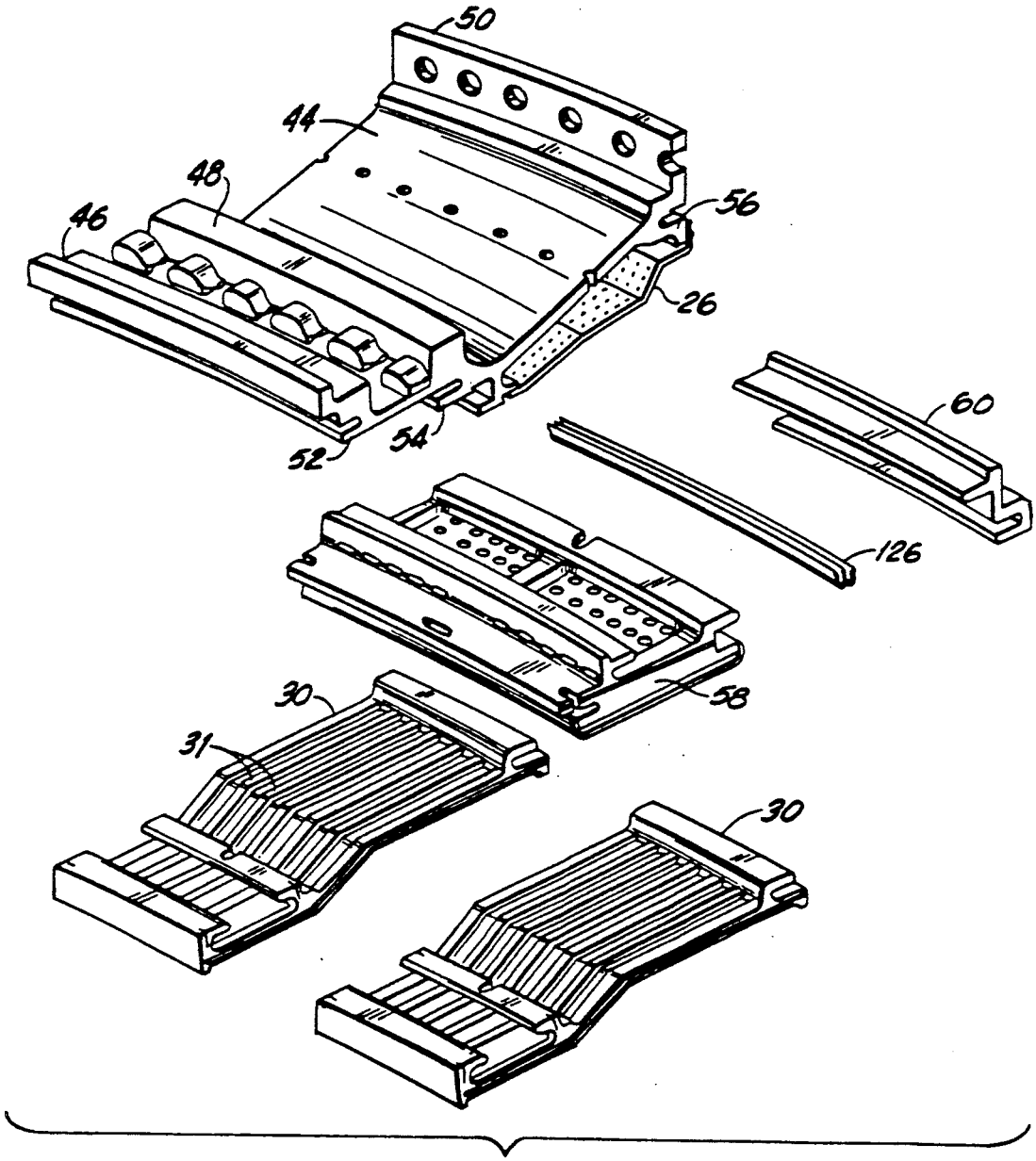

Each forward shroud hanger 58 is formed with an axially forwardly projecting front engagement flange 62, an axially rearwardly projecting mid engagement flange 64 and a pair of radially spaced inner and outer axially rearwardly projecting rear engagement flanges 66, 68. Each aft shroud hanger 60 is formed with a pair of radially spaced inner and outer axially forwardly projecting engagement flanges 70, 72. As seen in FIGS. 3 and 4, the forward and aft shroud hangers 58, 60 provide for circumferential tongue-in-groove interconnections between the mounting hooks on the shroud segments and the shroud support and the engagement flanges on the forward and aft segmented shroud hangers.

In order to closely control and maintain uniform blade tip clearance, the thermal expansion and contraction of the shroud support 44 and the shroud segments 30 must be closely and evenly controlled. The primary parameter influencing the shroud support temperature response is the heat transfer coefficients (h) of the cooling air on the position control rings 46, 48, 50. The major factors contributing to these heat transfer coefficients are the cooling air flow rate and velocity. The present invention controls and maintains these heat transfer coefficients circumferentially uniformly by establishing a swirling circumferentially directed flow in a fixed cavity formed between the forward and mid clearance control rings 46, 48.

The major air flow cooling paths are shown in FIG. 4. Shroud cooling air first passes through hole formed in the forward shroud hanger 58 and then between the forward and mid position control rings 46, 48 before reaching the rear position control ring 50. Specifically, cooling air 74 enters annular cavity A through ports 76. A portion of this air is directed radially inwardly through ports 78 and through segmented impingement baffles 80 and against the high pressure portion 83 of the shroud segments 30. Another portion of this air is directed radially outwardly through ports 82 into cavity B.

A high pressure ratio is established across the ports 82 to produce a choked or near choked flow condition so the exit air velocity from cavity A is essentially fixed (sonic). In order to develop the desired swirling cooling air flow and obtain and control the desired heat transfer coefficient values on the forward and mid position control rings 46, 48, the air must be diffused to lower its velocity and then directed tangentially and circumferentially through cavity B, as described below.

After entering cavity B, the tangentially swirling air between the front and mid position control rings 46, 48 is directed axially toward the aft section of the shroud support 44. Most of the air is delivered to cavity C which is located adjacent the low pressure portion 85 of each of the shroud segments 30. Cooling air enters cavity C through holes 84 formed in the support cone portion 86 of the shroud support 44. A 360° impingement baffle 81 is attached to the turbine shroud support 44 for directing and metering impingement cooling air from cavity C onto the low pressure portion 85 of the shroud segments 30.

The remaining air 88 is used for outlet guide vane cooling but also serves to heat or cool the aft flange (which forms the aft position control ring 50) as it passes through an aft flange cooling circuit. FIGS. 4(*a*) and 4(*b*) show the details of the aft flange cooling circuit. The aft flange 97 of the outer combustor casing 96 is radially slotted at 99 up to bolt holes 101. A similar slot 103 runs circumferentially along the flange 97. Similar slotted features 99, 103 are machined into the forward flange 105 of the attached turbine frame 107.

Air initially passes up and around the face of flange 97 of combustor case 96. The cooling air 88 is prevented from transferring directly through the aft position control ring 50 by a tight fit bolt at location 101(*a*). A loose fit bolt at 101(*b*) allows air to pass through the aft position control ring. The air 88 then travels again, circumferentially, back to the radial slot 99 in flange 105 before exiting. This arrangement produces uniform heating of the aft position control ring.

Figure 5:
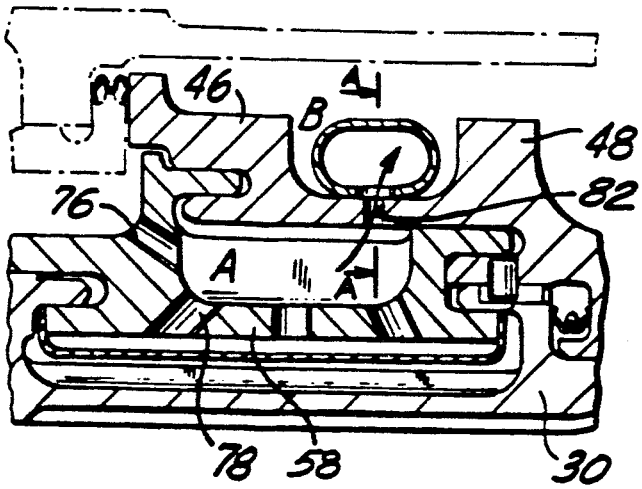
FIG. 5 is a fragmental axial sectioned view of a portion of the shroud system of FIG. 3 detailing the location of the swirl tubes.
Figure 6:
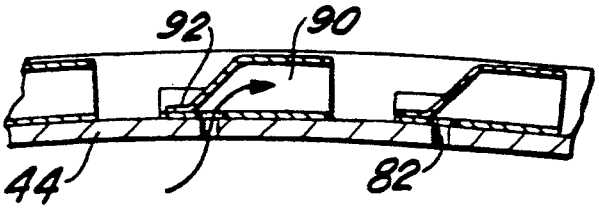
FIG. 6 is a fragmental circumferentially sectioned view taken through line A—A of FIG. 5.

Although several methods can be used to create the swirling flow between the forward and mid position control rings 46, 48, one design provides mini-nozzles cast into the shroud support 44. A preferred and more economical and light weight design involves the formation of a simple scoop 90 from a standard size tube as shown in FIGS. 5 and 6. Round tubing is formed to an ovalized shape and then crimped at one end 92. A series of scoops 90 is then brazed in a circumferentially spaced array to the shroud support 44 as shown. The oval shape of each scoop 90 is configured to yield the proper exit area to achieve the required airflow velocity for producing the desired heat transfer coefficients on the forward and mid position control rings 46, 48.

It is essential that all three shroud position control rings 46, 48, 50 respond uniformly in order to maintain blade tip clearance control and avoid bending of the shrouds. A prime function of the turbine shroud support 44 is to maintain minimal clearances between the shrouds and the turbine blade tips. This is best accomplished, steady state and transiently, if the thermal response of the shroud support is matched to that of the turbine rotor carrying the blades. The thermal response of the support is governed by its mass and the heat transfer coefficients at its boundaries. In order to establish the required heat transfer coefficient levels on the forward and mid position control rings 46, 48, the transient temperature response of the shroud support 44 is determined and designed to match the thermal growth of the high pressure blade disk which supports the high pressure turbine blades 22.

Likewise, the heat transfer coefficients on the aft or rear position control ring 50 are established by setting the geometry of the cooling circuit and pressure ratio to respond in equal unison with the forward and mid position control rings 46, 48. This is accomplished in part through matching the (thermal) mass of the position control rings as well as their stiffness. In this manner, the transient temperature response of all three position control rings is controlled to yield optimum clearance between the shroud segments and the high and low pressure turbine blades 22, 24.

The forward and mid position control rings are bounded by the same heat transfer coefficients. The aft position control ring heat transfer coefficient is not the same as that of the forward and mid position control rings. The thermal response is a function of the mass of the rings and their boundary heat transfer coefficients. As the mass of the aft position control is greater than that of the forward and mid position control rings, the heat transfer coefficient is different. The masses and heat transfer coefficients on the rings are established to give equal radial expansion and contraction to preclude bending of the shrouds.

As further shown in FIG. 4, an E seal 94 is provided between the shroud support 44 and combustor case 96 to control the pressure in cavity B to a desired value. The pressure in cavity B is set considerably lower than the pressure in cavity A thereby producing a significant outward radial load on the shroud support 44. However, there also exists an inward radial load on each position control ring mounting hook 52, 54, 56 due to the forward and aft hanger loads. The pressure loads are set to counteract the hanger loads in order to produce a zero net mechanical load across the shroud support 44. This feature allows the response of the position control rings to be controlled strictly by their thermal response, since their mechanical loads remain balanced at all conditions, including critical minimum clearance conditions which occur during throttle re-bursts.

The stresses in the shroud support 44 are thus greatly reduced as only thermal stresses are present and weight can be minimized as a result of counterbalancing the radial loads applied across the shroud support. Downstream of the forward and mid position control rings 46, 48, the reduced pressure in annular cavity B provides further benefit at the aft section of the shroud support 44. This low pressure is effective in reducing the pressure differential across the support cone 86 thereby limiting stresses at key locations where otherwise high bending stresses and undesirable mechanical deflections would occur.

The stepped and sequentially reduced cavity pressure from cavity A to cavity B to cavity C results in high pressure ratios across the shroud support structure. These high pressure ratios result in choked or near choked flow conditions across the cooling air ports 82, 84 thereby providing excellent air flow control, even if the cavity pressures fluctuate somewhat due to seal deterioration. This well maintained cooling flow system assures good blade tip clearance control since the heating and cooling heat transfer coefficients of the position control rings remain stable. Moreover, proper control of the cooling air 74 applied to the shroud segments 30 is also assured by this design.

Figure 7:
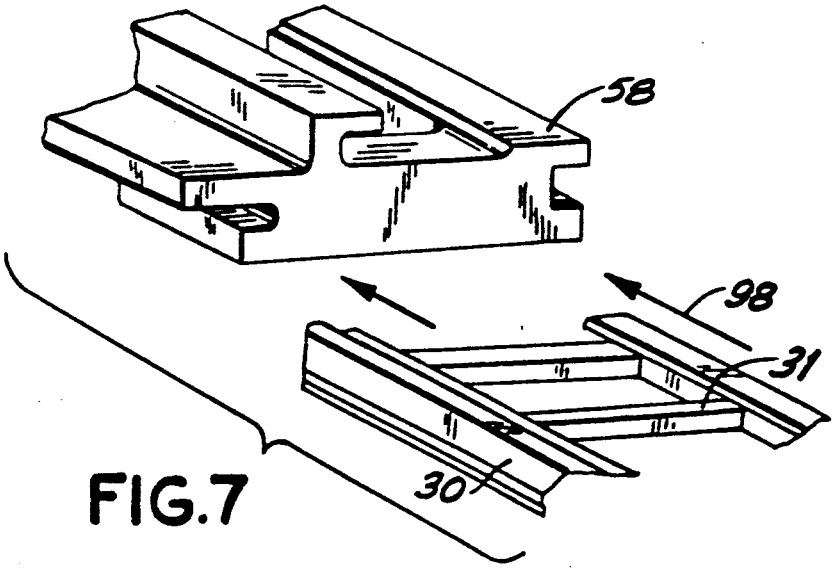
FIG. 7 is a schematic fragmental perspective view showing the tangential assembly of the shroud to the forward shroud hanger.
Figure 8:
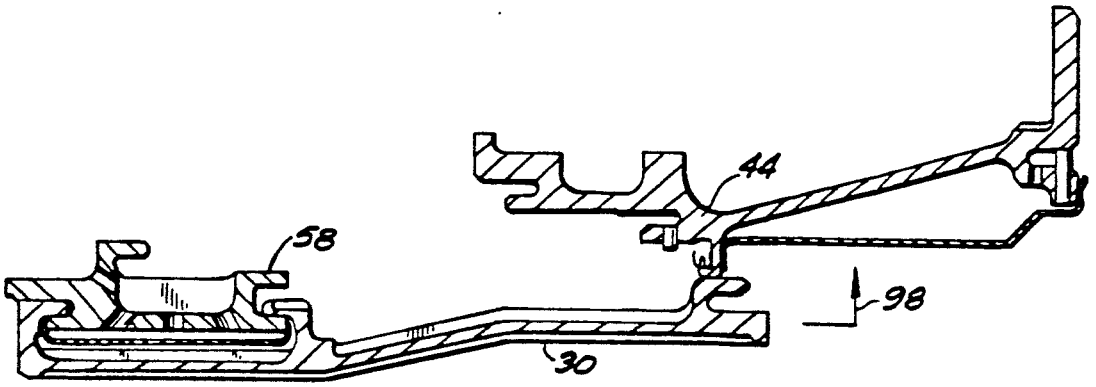
FIGS. 8 through 10 are axial side elevation views showing the assembly sequence involved in mounting the shroud and forward shroud hanger to the shroud support.
Figure 9:
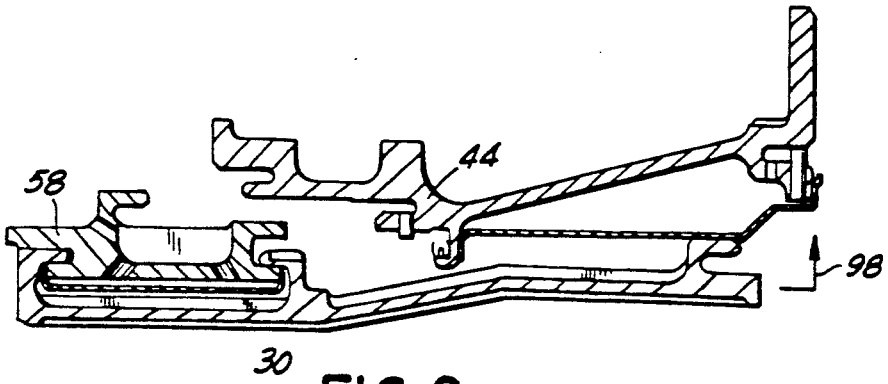
Figure 10:
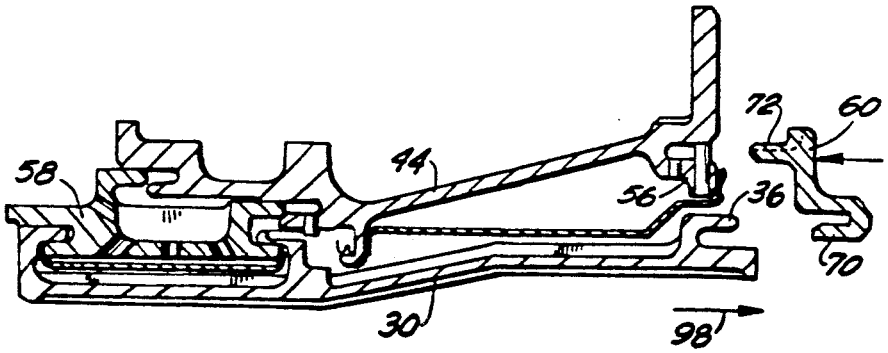

The assembly procedure for the shroud support system is outlined in FIGS. 7 through 10 wherein the directional arrows 98 indicate the relative direction of movement between the parts. This assembly procedure provides for ease of assembly and enhanced performance. First, two shroud segments 30 are assembled tangentially onto one forward hanger 58 as shown in FIG. 7. Next, the forward hanger 58 along with two shroud segments 30 is assembled axially into the 360° shroud support 44 as shown in FIGS. 8 and 9 where in each figure, an aft directed axial assembly movement of the shroud support is followed by a radially outward movement. Finally, the aft hanger 60 is assembled axially to engage the shroud rear mounting hook 36 and shroud support 44 via rear mounting hook 56.

Experience indicates that shroud segments assume a permanent arc distortion due to thermal gradients experienced during engine operation. This distortion generally makes it difficult or even impossible to slide a shroud segment 30 circumferentially across its shroud support 44, if tight clearances are to be maintained during normal operation. To prevent this binding during disassembly, a decoupling feature has been incorporated in the present invention.

Figure 11:
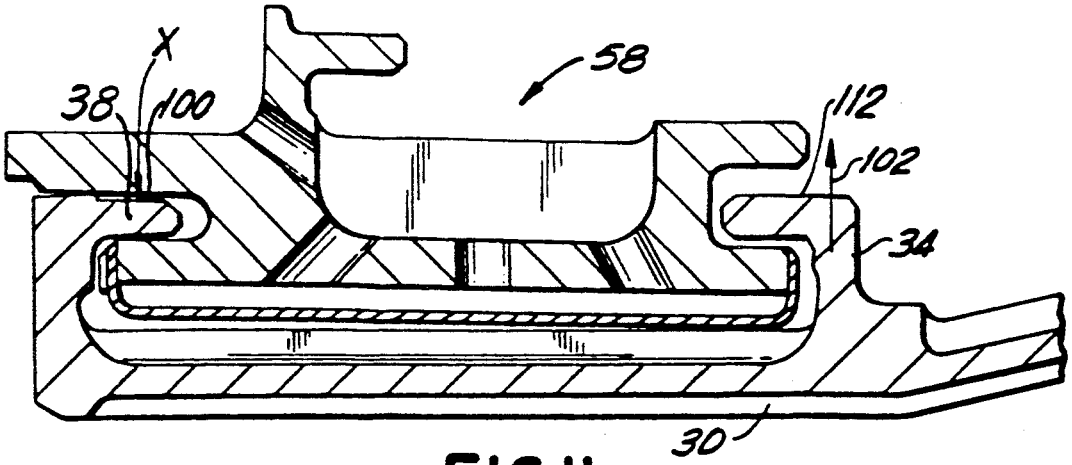
FIG. 11 is a fragmental axial view showing the disassembly of the shroud from the shroud support.
Figure 11A:
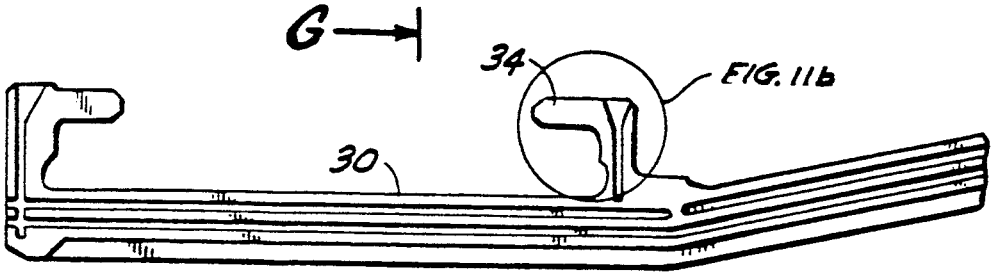
Figure 11B:
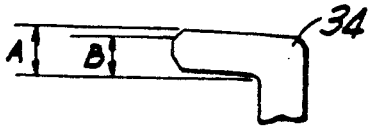
Figure 11C:
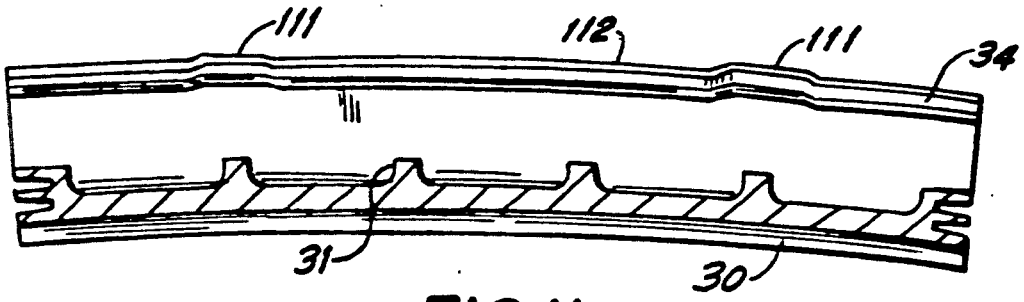

The decoupling feature includes a radial relief 100 or radial recess which is machined in the outer circumference of the shroud forward mounting hook 38 as shown in FIG. 11, at point X. After axial disengagement of the forward hanger 58 along with two attached shroud segments 30 from the shroud support 44 is completed by reversing the assembly sequence, relief 100 allows the shroud mid mounting hook 34 to move radially outward, as shown at 102. This rotation of the shroud segment 30 permits its free tangential and circumferential movement even in a distorted condition and thereby facilitates disassembly.

The assembly of the forward segmented hangers 58 into the shroud support 44 is straightforward with only two hanger flanges, the forward and mid flanges 64, 68, engaging the shroud support. Therefore, even though each shroud segment 30 includes three mounting hooks, only two hooks, the forward and mid hanger flanges (hooks), must engage the shroud support, thereby providing a simple and maintainable assembly since much less distortion occurs on the forward hangers during engine operation. That is, the shroud segments experience temperature gradients between the flowpath and their mounting hooks of 400°–500° F. As the shroud segments are restrained, the thermal stresses may exceed the material's yield strength and take a permanent set.

Figure 12:
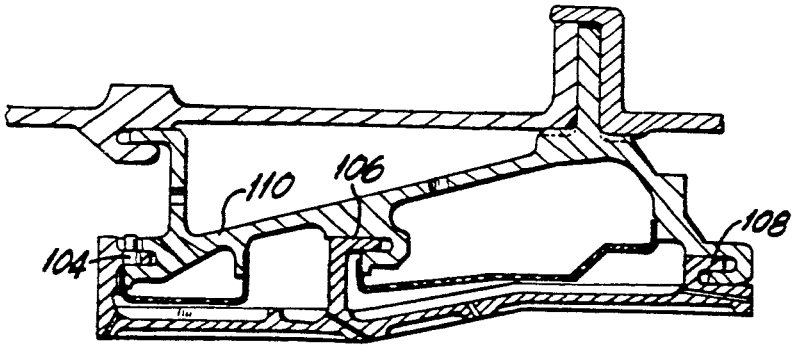
FIG. 12 is a fragmental axial sectioned view of an alternate embodiment of a gas turbine engine shroud.

By comparison, radial temperature gradients in the shroud hangers are typically about 50° F. and hence they do not exhibit such distortion. This is a major improvement over an alternate design shown in FIG. 12 which requires the engagement of three mounting hooks 104, 106, 108 simultaneously into the shroud support 110 and thus requires loose tolerances with a resulting sacrifice in blade-tip clearance control and cooling air leakage.

Referring again to FIGS. 4, 11, 11(*a*), 11(*b*) and 11(*c*) the shroud mid mounting hook 34 is dimpled at 111 on its outer surface 112 to assure an extremely tight interference fit against the inner surface 114 of the shroud support mid mounting hook 54 without actually engaging any grooves. The dimples 111 also assure only local contact of the shroud segments 30 to the shroud support 44, so that the shroud mid mounting hook temperature has little, if any, effect on the temperature of the shroud support mid position control ring 48. As seen in FIG. 11(*b*), dimension A on mid mounting hook 34 may be about 0.095 inch and dimension B may be about 0.090 inch.

Figure 1:
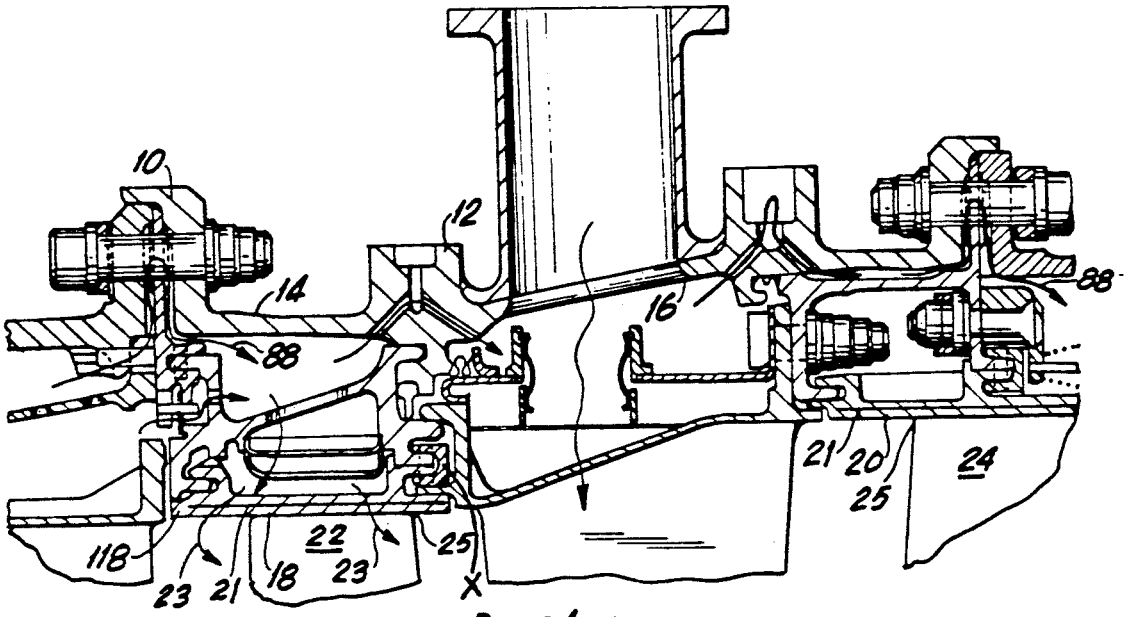
PRIOR ART FIG.1
FIGS. 1 and 2 are fragmental axial sectioned views of gas turbine engine shroud systems according to the prior art.
Figure 2:
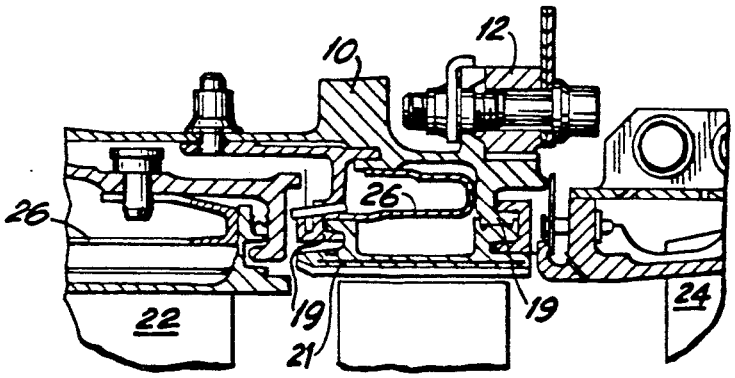
PRIOR ART FIG.2
Figure 2A:
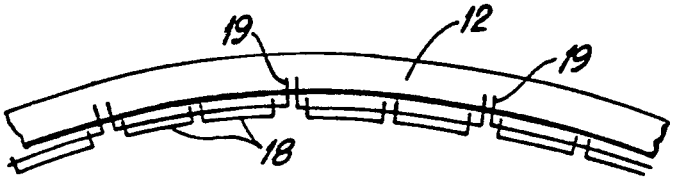

The aft end of the forward hanger 58 acts much the same as a C-clip to keep the shroud segments 30 and shroud support 44 closely coupled and radially clamped together at the shroud mid mounting hook 34. C-clips are used on state of the art shroud designs of the type shown in FIG. 1 to secure the shrouds in position radially. Reference to FIG. 1 shows a C-clip at location X. C-clips are segments equal in circumferential length to an individual shroud. They are usually a force fit installation to insure that the shroud is held tightly to the support. This precludes any radial movement of the shroud relative to the support which would cause an increase in operating clearance. In the present invention, the aft end of the forward hanger clamps the shroud 30 to the support hook 54 and hence functions in a similar manner to a C-clip.

Figure 13:
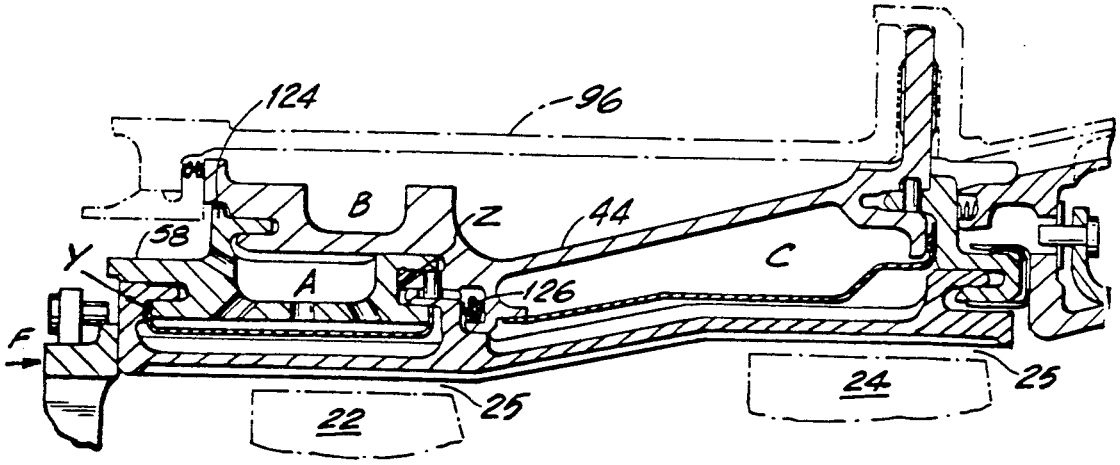
FIG. 13 is a fragmental axial sectioned view of the shroud as depicted FIG. 3 and further depicting the axial retention of the shroud within the engine combustor casing.

As seen in FIG. 13, the aft end 116 of the high pressure turbine nozzle, which is located immediately upstream of the shroud segments 30, is designed to react its axial pressure load against the segmented shroud. The load, F, is transferred directly to the forward hangers 58 and reacted through the shroud support 44 to the combustor case 96 as further shown in FIG. 13. This feature eliminates the need for a nozzle outer support as currently required on other engines.

Just as importantly, this large axial load from the high pressure nozzle is used to seal the shroud segments 30 against the forward hangers at point Y and to seal the forward hangers 58 against the shroud support at point Z. While this design positively restrains these parts axially, it also provides excellent face seals to effectively seal and separate the varying pressures in cavities A, B, and C and further acts to seal off critical leakage paths.

A comparison of FIGS. 1 and 4 will show that due to the arrangement of the shroud forward and mid mounting hooks 32, 34, the typical overhang 118 (FIG. 1) at the forward and aft ends of conventional high pressure turbine shroud 18 is eliminated. The arrangement of the impingement baffles 80 on the forward hanger 58 allows for impingement cooling of the entire back side of each shroud segment 30, especially at the forward mounting hook corner and mid mounting hook where the highest temperatures and bending stresses are prevalent. This invention eliminates the need for a brazed impingement baffle on the shroud as required on previous designs.

Figure 14:
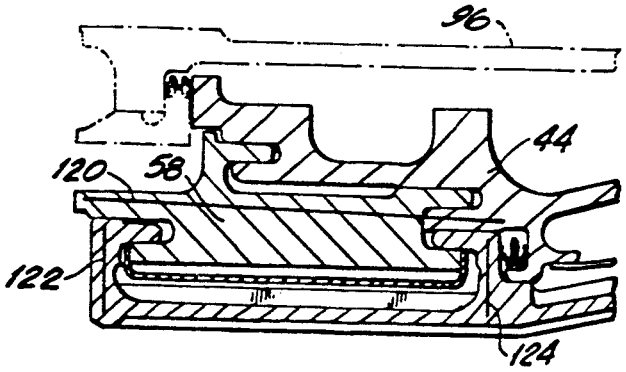
FIG. 14 is a fragmental axial sectioned view of a forward portion of the shroud as depicted in FIG. 3 and further depicting the location of the shroud seals.

It is generally considered desirable to employ continuous 360° impingement baffles to reduce parasitic leakage of cooling air across the shim seals as noted above. The use of segmented shroud hangers, however, requires the use of added shim seals and can result in additional leakage. Specifically, as seen in FIG. 14, a forward hanger spline seal 120 provides a seal between adjacent forward hangers, and forward and mid mounting hook seals 122, 124 provide seals between adjacent shroud segments 30. However, since the pressure ratio across these seals is very low, leakage amounts to less than 5% of the total flow. This is negligible compared to the cooling air savings realized by the efficient use of impingement air and the other sealing features described above.

The shim or spline seals 120 between the forward hanger segments also serve to retain the shim seals 122, 124 at both the forward and mid shroud hooks (see FIG. 14). This is a key feature in simplifying the assembly procedure and offers a clear maintainability advantage.

It can now be appreciated that the present invention maintains control of and improves blade tip clearances by employing a circumferentially swirling air flow to uniformly control the shroud support transient temperature response. The swirling flow between the position control rings effectively eliminates the possibility of obtaining a circumferentially non-uniform position control ring temperature.

The forward and mid position control rings, which are critical in establishing the high pressure blade tip clearance, are divorced from all air flow and temperature effects which occur outside the combustor case 96. Both of these position control rings respond uniformly since the swirling flow affects each one alike. Although three position control rings are used to control blade tip clearances, only two heat transfer coefficient levels are critical to obtaining a matched thermal response since the forward and mid position control rings are controlled by the same air and temperature source.

The tangential air scoops 90 efficiently deflect and turn the radial flow of the cooling air and direct it tangentially. The air scoop design can be easily tuned by adjusting the exit flow area of the air scoop tubes to yield the desired air flow velocity necessary for establishing preset heat transfer coefficient values as noted above. Use of a round tube to fabricate the air scoops offers excellent control and tolerance over the required exit area, since the tube perimeter remains constant. Using a standard round tube to fabricate the air scoops is also very cost effective.

The single piece shroud segments 30 are designed to span over both the high pressure and low pressure turbine blade rows. With the shroud segment mounting hooks facing each other as described, impingement air can be used to cool the entire back side of each segment. The tangentially loaded, i.e. tangentially assembled, shroud design further eliminates the forward overhang of prior designs. The relief or recess on the forward shroud hooks allows for this tangential assembly.

When the shroud segments are at operating temperature, their gas path sides run hotter than their mounting hooks. As a result, the shroud segments try to chord, that is, become flat rather than curved segments. The shroud support resists this chording and so high contact forces develop at the ends and center of the shroud segments. As the shroud segments also expand thermally in their axial direction, relative to the shroud support, the shroud segments may tend to "walk off" the shroud support as the contact forces try to anchor the shroud segments by friction and the thermal growth causes them to move or "walk". This is known as thermal ratcheting.

By having the shroud segments attached via segmented shroud hangers, the resisting contact force is much reduced. That is, the force required to deflect the edges of a curved shroud hanger is significantly less than that required to locally deflect a 360 degree ring by a similar amount. As the friction or anchor force is reduced, the tendency to thermal ratchet is also reduced.

Since the shroud mid mounting hook faces forward, unlike the forward and aft shroud mounting hooks, the shroud cannot move foward, e.g. due to thermal ratcheting as experienced on prior designs without also moving the forward hanger. The possibility of this occurring is greatly reduced since none of the mounting hooks engage a 360° groove which is much stiffer than segmented grooves. Furthermore, the C clip type of engagement at the shroud mid mounting hook tends to force the shroud aft, as is desired.

If, however, the shroud segments and forward hangers should move forward, an axial stop 124 (FIG. 13) on the forward shroud hanger limits the forward axial movement. Leakage across the shroud mid mounting hook is minimized by the use of an E seal 126. The close coupling of the shroud and shroud support at this location results in virtually zero relative radial motion and is thus an ideal design application for an E seal. If the shroud mid mounting hook were reversed in direction, the hook would have to be much longer to accommodate the E seal. The disclosed design therefore minimizes both leakage and weight.

Since the shroud mid mounting hook faces forward, the transition section of the shroud between the high pressure and low pressure cylindrical flowpaths is more accessible for accompaniment of a borescope boss. This is a key reason for directing the shroud mid mounting hook forward since in prior designs the borescope boss arrangement is overly complex.

A large pressure drop is imposed on the shroud support to counteract the shroud pressure loads. Therefore, the radial deflection of the position control rings is only affected by their temperature response. Where even higher pressure drops are acceptable, the position control rings can be designed to have a net outward deflection which would improve (reduce) overall clearances. The radially balanced mechanical loading results in low stresses in the shroud support and allows for a lightweight system.

The forward and mid position control rings are situated directly over the high pressure shroud portion 83 in order to maximize the control of the high pressure blade tip clearance which has the greatest impact upon turbine efficiency. The high pressure ratio across the shroud support results in near choked flow conditions which offers excellent control over the cooling flow levels.

There has been disclosed heretofore the best embodiment of the invention presently contemplated. However, it is to be understood that various changes and modifications may be made thereto without departing from the spirit of the invention.

What is claimed is:

1. A segmented shroud assembly for a gas turbine engine having a plurality of high pressure turbine blades on a high pressure turbine rotor and a plurality of low pressure turbine blades on a low pressure turbine rotor, said shroud assembly comprising:

a plurality of shroud segments arranged circumferentially to form a segment shroud, wherein said shroud segments are arranged within said gas turbine engine so as to axially span both said high pressure turbine blades and said low pressure turbine blades.

2. The assembly of claim 1, further comprising a one-piece annular shroud support connecting said segmented shroud to said turbine engine.

3. The assembly of claim 2, further comprising a plurality of segmented shroud hangers interconnecting said shroud segments with said shroud support.

4. The assembly of claim 3, wherein said annular shroud support comprises a forward position control ring, a mid position control ring and an aft position control ring.

5. The assembly of claim 4, wherein said plurality of segmented shroud hangers comprises a plurality of forward shroud hangers engaging said shroud support in radial planar alignment with said forward position control ring and said mid position control ring.

6. The assembly of claim 5, wherein said plurality of segmented shroud hangers comprises a plurality of aft shroud hangers engaging said shroud support in radial planar alignment with said aft position control ring.

7. A one-piece shroud segment for use in a segmented gas turbine engine shroud of a gas turbine engine having a plurality of high pressure turbine blades on a high pressure turbine rotor and a plurality of low pressure turbine blades on a low pressure turbine rotor, said shroud segment comprising:

a one-piece shroud segment having a high pressure shroud portion integrally formed with a low pressure shroud portion; and a forward mounting member, a mid mounting member, and an aft mounting member for mounting said shroud segment to the gas turbine engine wherein said shroud segment is of sufficient axial length so as to axially span both the high pressure turbine blades and the low pressure turbine blades.

8. The shroud segment of claim 7, wherein said mid mounting member comprises an axially forwardly projecting free end portion.

9. The shroud segment of claim 8, wherein said forward mounting member comprises an axially rearwardly projecting free end portion and said aft mounting member comprises an axially rearwardly projecting free end portion.

10. The shroud segment of claim 7, wherein said forward mounting member is formed with a radial recess for facilitating disassembly of said shroud segment from said gas turbine engine.

11. A shroud assembly for a gas turbine engine, comprising:

a segmented tubine shroud;

a shroud support for radially positioning said segmented turbine shroud within said gas turbine engine;

a plurality of segmented forward hanger members interconnecting said segmented turbine shroud and said shroud support; and a plurality of segmented aft hanger members interconnecting said segmented turbine shroud and said shroud support such that a first cooling air cavity is formed between said forward hanger members and said shroud support and a second cooling air cavity is formed between said shroud support and said segmented turbine shroud and said aft hanger members.

12. The assembly claim 11, wherein cooling air pressure on said first cavity is maintained at a first predetermined value and wherein cooling air pressure in said second cavity is maintained at a second predetermined value which is less than said first predetermined value.

13. The assembly of claim 12 wherein said first and second cooling air pressures in said first and second cavities are maintained at levels which counteract mechanical loads applied to said shroud assembly.

14. The assembly of claim 11, wherein said shroud support comprises a first position control ring and a second position control ring, said first and second position control rings being located on the exterior of said first and second cavities.

15. The assembly of claim 11, further comprising a combustor case encircling said shroud support and wherein a third cooling air cavity is formed between said combustor case and said shroud support.

16. The assembly of claim 12, further comprising a combustor case encircling said shroud support and wherein a third cooling air cavity is formed between said combustor case and said shroud support.

17. The assembly of claim 16 wherein cooling air pressure in said third cavity is maintained at a third predetermined value which is between said first and second predetermined values.

18. The assembly of claim 15 wherein said third cavity receives cooling air from said first cavity and directs cooling air into said second cavity.

* * * * *